United States Patent [19]

Schmidt

[11] Patent Number: 4,920,651

[45] Date of Patent: May 1, 1990

[54] SHEETROCK BEVELING APPARATUS

[76] Inventor: Douglas W. Schmidt, R.R. 2, Box 135, Mott Farm Rd., Tomkins Cove, N.Y. 10986

[21] Appl. No.: 309,610

[22] Filed: Feb. 13, 1989

[51] Int. Cl.[5] ..... B27C 1/10

[52] U.S. Cl. ..... 30/475; 30/481; 30/484

[58] Field of Search ..... 30/475, 481, 484; 51/283 E, 283 R

[56] References Cited

U.S. PATENT DOCUMENTS

| | | | |
|---|---|---|---|
| 3,137,105 | 6/1964 | Conover . | |
| 3,407,857 | 10/1968 | Bentley | 30/475 |
| 3,585,760 | 6/1971 | Richmond . | |
| 3,664,614 | 5/1972 | Baechle . | |
| 3,828,484 | 8/1974 | Baechle . | |
| 4,603,479 | 8/1986 | Bergler | 30/475 |

*Primary Examiner*—Frederick R. Schmidt
*Assistant Examiner*—M. Rachuba
*Attorney, Agent, or Firm*—Henderson & Sturm

[57] ABSTRACT

A sheetrock beveling apparatus having a housing with a substantially planar surface on one side thereof. A handle is attached to the other side of the housing. A blade is rotatably attached to the housing about an axis and includes an electric motor for selectively causing the blade to rotate. An elongated guide is attached to the housing on the planar surface thereof so that it can travel in a seam between two abutting pieces of sheetrock to guide the blade along the edges of sheetrock to bevel the abutting edges of the sheetrock. This elongated guide extends longitudinally transverse to the axis of the rotation of the blade. The blade is longer in the center portion thereof than at the sides thereof to produce a tapering effect so that the more sheetrock is removed closer to the seam and progressively less is removed from the edge of the sheetrock as the distance from the seam between the two pieces of sheetrock increases.

4 Claims, 2 Drawing Sheets

SHEETROCK BEVELING APPARATUS

TECHNICAL FIELD

The present invention relates generally to a sheetrock beveling apparatus and more particularly to such an apparatus for use on the construction site to bevel the edges of two abutting pieces of sheetrock which have already been installed.

BACKGROUND ART

Sheetrock has become an expensive commodity especially since energy costs have risen in recent years. Wastage factors start at ten percent for standard bi-level homes to fifteen percent for custom built contemporary homes. A big factor in causing this waste is the undesirability of "butt joints". Butt joints are non-bevel end joints of sheetrock requiring a bulge of spackle to seal the joints, and this bulge of spackle is noticeable to homeowners and is undesirable. Tons of material are thrown out each year because it is too short. Longer and longer boards are being ordered and the cost of disposing of waste is escalating, especially since many landfills are being closed. Consequently, there is a need for a solution to the aforementioned problems.

DISCLOSURE OF THE INVENTION

The present invention relates generally to a sheetrock beveling apparatus having a housing with a substantially planar surface on one side thereof. A handle is attached to the other side of the housing. A blade is rotatably attached to the housing about an axis and includes an electric motor for selectively causing the blade to rotate. An elongated guide is attached to the housing on the planar surface thereof so that it can travel in a seam between two abutting pieces of sheetrock to guide the blade along the edges of sheetrock to bevel the abutting edges of the sheetrock. This elongated guide extends longitudinally, transverse to the axis of the rotation of the blade. The blade is longer in the center portion thereof than at the sides to produce a tapering effect so that the more sheetrock is removed closer to the seam and progressively less is removed from the edge of the sheetrock as the distance from the seam between the two pieces of sheetrock increases.

An object of the present invention is to provide a sheetrock beveling apparatus useful to bevel abutting edges of sheetrock after the sheetrock has been attached to a wall or the like.

Another object of the present invention is to provide a sheetrock beveling apparatus of the aforementioned type for reducing sheetrock waste and for preventing noticeable bulges in sheetrock seams.

A still further object of the present invention is to provide a sheetrock beveling apparatus which is economical to construct and easy to use.

Other objects, advantages, and novel features of the present invention will become apparent from the following detailed description of the invention when considered in conjunction with the accompanying drawings.

BEST MODE FOR CARRYING OUT THE INVENTION

Figure 1:
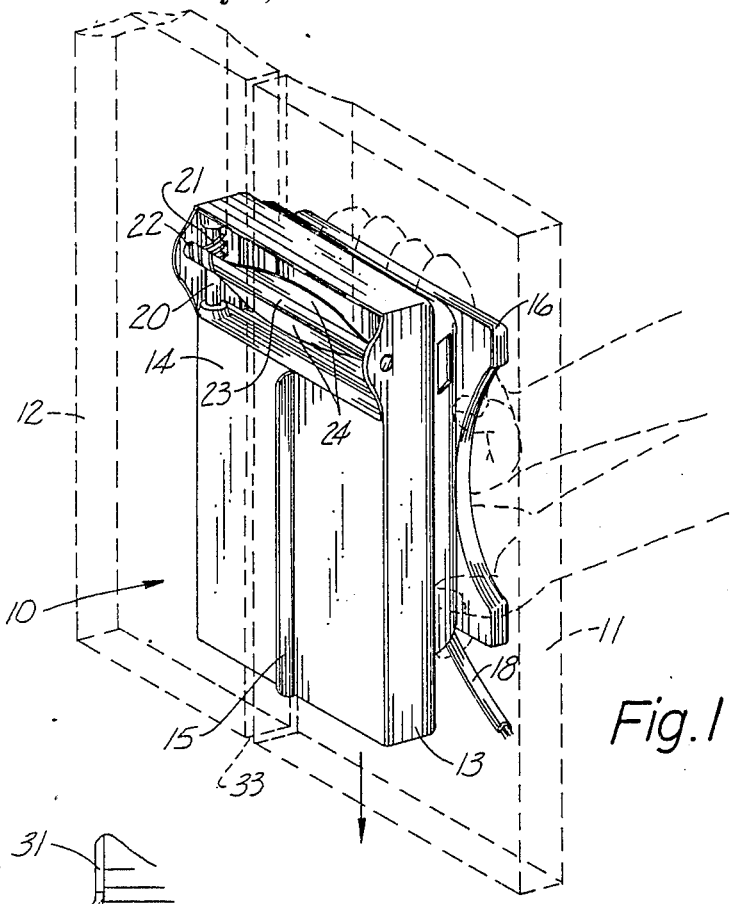
FIG. 1 is a perspective view of a preferred embodiment of the present invention shown in use on two abutting pieces of sheetrock which are shown in dashed lines and also showing the operator's hands in dashed lines.

Referring now to the drawings wherein like reference numerals designated identical or corresponding parts throughout the several views, FIG. 1 shows a sheetrock beveling apparatus (10) constructed in accordance with the present invention shown in operation against a seam between two abutting pieces of sheetrock (11) and (12) shown in dashed lines.

The sheetrock beveling apparatus (10) includes a housing (13) having a bottom planar portion (14) with an elongated guide (15) disposed longitudinally in the center thereof. The other side of the sheetrock beveling apparatus (10) has a handle (16).

Figure 6:
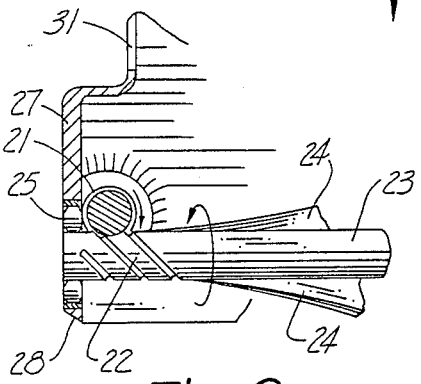
FIG. 6 is an enlarged partial cross sectional view taken along line 6—6 of FIG. 4.
Figure 7:
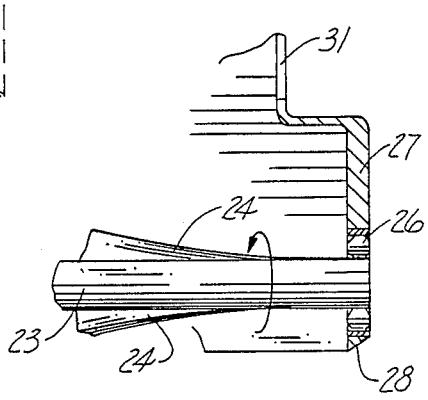
FIG. 7 is an enlarged partial cross sectional view taken along line 7—7 of FIG. 5.

The handle (16) has an electric motor (17) disposed therein powered by an electric cord (18) extending from the handle (16). The electric motor (17) turns a worm gear (19) which, in turn, turns the worm gear (20) on one end thereof. This rotary motion is translated to the worm gear structure (21) on the opposite end of the worm gear shaft (20). The worm gear (21) translates its motion 90° to a worm gear (22) on blade shaft (23), causing the shaft (23) to rotate in the direction of the arrows shown in FIGS. 6 and 7.

Sharpened blades (24) are rigidly attached to the blade shaft (23) and bearings (25) and (26) rotatably attach the blade shaft (23) to the housing on outwardly extending flanges (27). The bottom of the outwardly extending flanges (27) have cutting edges (28) thereof for cutting the paper on the sheetrock to form a smooth cutting edge.

Figure 8:
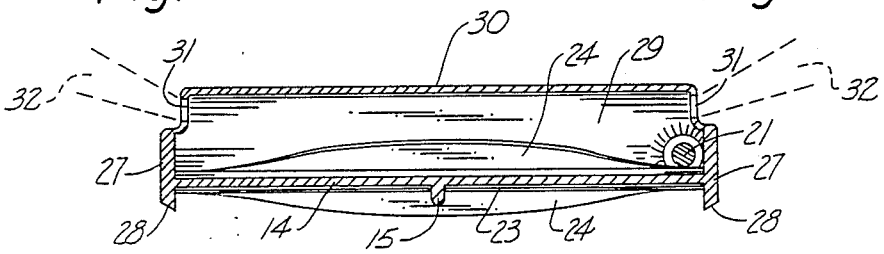
FIG. 8 is a cross sectional view taken along line 8—8 of FIG. 3.
Figure 4:
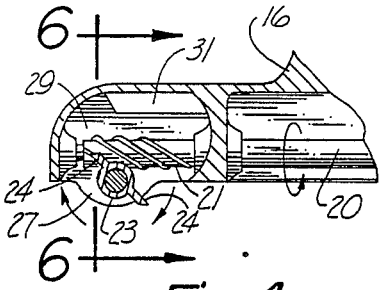
FIG. 4 is an enlarged partial cross sectional view taken along line 4—4 of FIG. 2.
Figure 5:
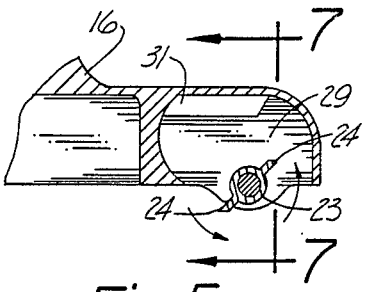
FIG. 5 is an enlarged partial cross sectional view taken along line 5—5 of FIG. 2.
Figure 2:
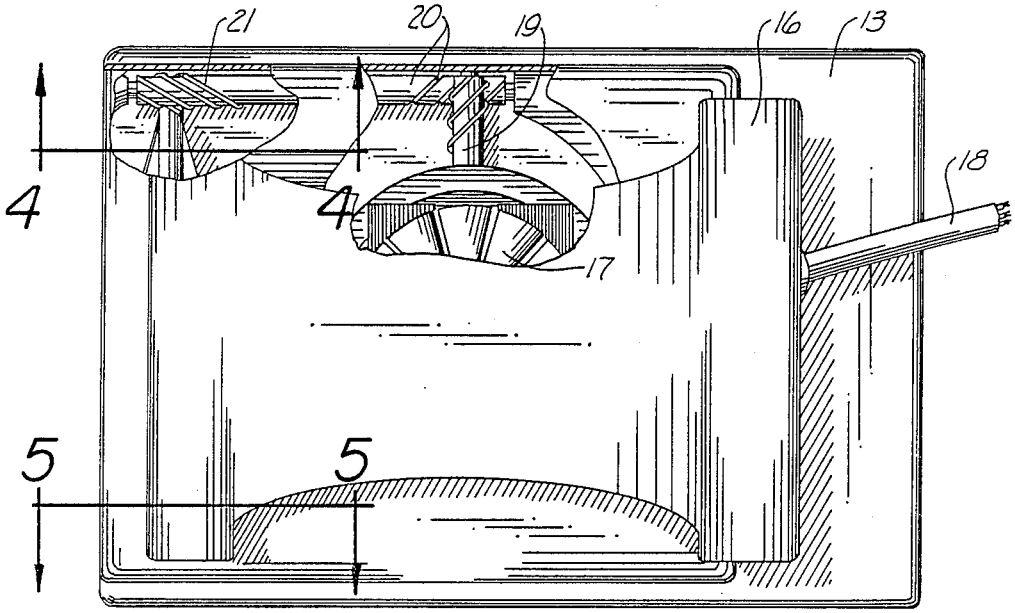
FIG. 2 is a top view of the preferred embodiment of the present invention with portions thereof broken away to show the working parts therein.
Figure 3:
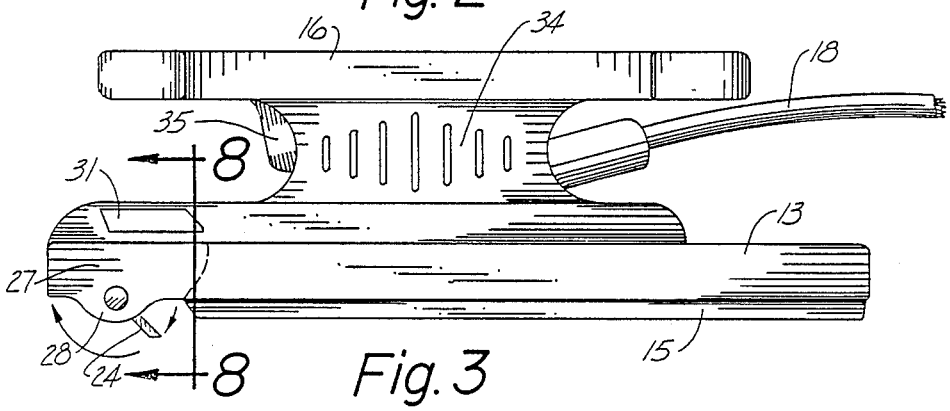
FIG. 3 is a side elevational view, the opposite side being substantially a mere image of the side shown.

A chamber (29) is formed between the outwardly extending flanges (27) and a top surface (30) connected to the housing (13). Exhaust ports (31) are shown in FIG. 8. Optional vacuum hoses (32) can be attached to the ports (31) if it is desired to connect a shop vacuum thereto to receive shavings from the sheetrock beveling apparatus (10) rather than to allow such shavings to merely exit out of the exhaust ports (31). A trigger switch (35), shown in FIG. 3, is similar to that on a conventional electric drill for the purpose of selectively turning the motor (17) on or off.

In operation, when it is desired to utilize the sheetrock beveling apparatus (10) shown in the drawings, the sheetrock (11) and (12) would already be nailed to the wall with no fasteners being close to the seam (33) shown in FIG. 1. The sheetrock beveler can be made approximately the same size with respect to a human's hand as shown in FIG. 1 or it can be made somewhat smaller so that it can be operated with one hand alone grasping the recessed portions of the handle (16).

With the guide (15) forced into the seam (33) between sheetrock pieces (11) and (12), the switch trigger (35) can be used to actuate the electric motor (17) to thereby rotate worm gears (19), (20), (21) and (22), thereby causing rotation of the blades (24) and blade shaft (23). Then the planar surface (14) in guide (15) are slid along the seam (33) and sheetrock portions (11) and (12; to bevel the abutting edges of the sheetrock pieces (11) and (12). As this is done, the shavings from the sheetrock produced by rotation of the blades (24) will exit through exhaust ports (31) and, if hoses (32) are attached to the exit ports (31) a shop vacuum (not shown) will be pulling the shavings into a container to be disposed of later. Otherwise the shavings will merely fall to the floor after exiting ports (31).

Accordingly, it will be appreciated that the preferred embodiment (10) disclosed herein does indeed accomplish the aforementioned objects. Obviously many modifications and variations of the present invention are possible in light of the above teachings. It is therefore to be understood that, within the scope of the appended claims, the invention may be practice otherwise than as specifically described.

I claim:

1. A sheetrock beveling apparatus for use with a pair of abutting pieces of sheetrock to bevel the opposed edges of the sheetrock, wherein the apparatus comprises:

a housing, said housing having a substantially planar surface on one side thereof;

a handle attached to the opposite side of said housing;

a blade having a cutting edge wherein the effective cutting surface of the edge is wider at the center than at the ends thereof such that the center of the blade will extend a greater distance than the ends beyond the planar surface of said housing during rotation thereof to produce a beveled cut on the opposed surfaces of the abutting pieces of sheetrock;

means for rotatably attaching said blade to said housing about an axis;

power means for selectively causing said blade to rotate; and an elongated guide means attached to said housing on said planar surface and being dimensioned to be received in a seam between said two abutting pieces of sheetrock to guide said blade to bevel the abutting edges of sheetrock, said elongated guide means extending longitudinally transverse to the axis of rotation of said blade.

2. The sheetrock beveling apparatus of claim 1 including means for forming a chamber in said housing to receive said blade and guide the path of the shavings made by said blade.

3. The sheetrock beveling apparatus of claim 3 including a pair of exhaust ports on opposite edges of said housing in communication with said chamber for permitting said shavings to exhaust therethrough.

4. The sheetrock beveling apparatus of claim 1 wherein said housing further comprises:

a pair of opposed flanges disposed parallel to said elongated guide means wherein the flanges are provided with cutting edges.

* * * * *